US005478685A

United States Patent [19]

Nogami et al.

[11] Patent Number: 5,478,685

[45] Date of Patent: Dec. 26, 1995

[54] PHOTOCONDUCTOR FOR ELECTROPHOTOGRAPHY

[75] Inventors: Sumitaka Nogami; Hideki Kina; Kaneyuki Mantoku, all of Kawasaki, Japan

[73] Assignee: Fuji Electric Co., Ltd., Kanagawa, Japan

[21] Appl. No.: 220,418

[22] Filed: Mar. 31, 1994

[30] Foreign Application Priority Data

Apr. 2, 1993 [JP] Japan ..... 5-076023

[51] Int. Cl.[6] ..... G03G 5/14

[52] U.S. Cl. ..... 430/59; 430/60; 430/62; 430/64

[58] Field of Search ..... 430/60, 61, 62, 430/63, 64, 65, 59

[56] References Cited

U.S. PATENT DOCUMENTS 3,639,122 2/1972 Shimizu et al. ..... 430/60

FOREIGN PATENT DOCUMENTS

| | | |
|---|---|---|
| 2-59458 | 6/1983 | Japan . |
| 3-4904 | 6/1983 | Japan . |
| 59-9049 | 1/1984 | Japan . |
| 1-51185 | 6/1985 | Japan . |
| 2-62861 | 12/1985 | Japan . |
| 2-60177 | 5/1986 | Japan . |
| 2-48175 | 4/1988 | Japan . |
| 63-170651 | 7/1988 | Japan . |
| 4-31577 | 7/1988 | Japan . |
| 4-31576 | 7/1988 | Japan . |
| 2-59767 | 2/1990 | Japan . |
| 2-53070 | 2/1990 | Japan . |
| 2-79859 | 3/1990 | Japan . |
| 2-115858 | 4/1990 | Japan . |
| 2-105349 | 4/1990 | Japan . |
| 2-193152 | 7/1990 | Japan . |
| 2-238459 | 9/1990 | Japan . |
| 2-281262 | 11/1990 | Japan . |
| 2-280170 | 11/1990 | Japan . |
| 3-43744 | 2/1991 | Japan . |
| 3-48256 | 3/1991 | Japan . |
| 3-81778 | 4/1991 | Japan . |
| 3-150572 | 6/1991 | Japan . |
| 3-145652 | 6/1991 | Japan . |
| 3-288157 | 12/1991 | Japan . |
| 4-22966 | 1/1992 | Japan . |
| 4-31870 | 2/1992 | Japan . |

OTHER PUBLICATIONS

Journal of Photographic Science and Engineering, (1977) vol. 21, No. 2, p. 73, "Use of Pyrazoline–Based Carrier Tansport Layers in layered Photoconductor Systems for Electrophotography", P. J. Meiz, et al.

Journal of Imaging Science, (1985), vol. 29, No. 1, p. 7, "A New Class of Photoconductive Transport Materials: Substituted Phenyl and Diphnyl Acetaldehyde Enamines", S. L. Rice, et al.

*Primary Examiner*—John L. Goodrow

*Attorney, Agent, or Firm*—Spencer, Frank & Schneider

[57] ABSTRACT

An electrophotographic photoconductor has an intermediate layer formed between an electrically conductive substrate and photosensitive layer. The intermediate layer is made of a hardened film formed by hardening an amino resin with a catalyst comprising aromaticsulfonic acid, alicyclicsulfonic acid, a mixture thereof, or latent acid thereof to provide good image qualities without causing any troubles in the process of image formation.

13 Claims, 1 Drawing Sheet

PHOTOCONDUCTOR FOR ELECTROPHOTOGRAPHY

BACKGROUND OF THE INVENTION

1. Field of the Invention

The present invention-relates to a photoconductor for electrophotography that has an intermediate layer between an electrically conductive substrate and a photosensitive layer to stably obtain excellent electric properties and excellent image qualities under the condition of repeating the image-forming process.

2. Description of the Prior Art

From the time that the Carlson Process was invented by C. F. Carlson in 1938, technologies associated with electrophotography have been rapidly progressed and used in the data-processing systems such as photocopying machines, laser printers, light-emitting diode printers, facsimile, and so on.

The Carlson process is known as the electrophotographic process for image formation, that comprises the steps of:

(i) providing charges uniformly on a surface of the photosensitive member by means of corona discharge in the absence of light;

(ii) exposing a charged surface of the photosensitive member to light to form a latent image that is a charge pattern on the photosensitive member that mirrors the information such as characters and figures to be transformed into the real image;

(iii) developing the latent image by applying toner particles that are brought into the vicinity of the latent image to obtain a toner image; and (iv) transferring and fixing the developed toner image on a support medium such as a sheet of paper and plastics, following that the photosensitive layer is discharged and cleaned of any excess toner particles using coronas, lamps, and brushes and scraper blades, or both. Consequently, the image formation can be repeated by using the same photosensitive member.

The photosensitive member described above is generally called as an electrophotographic photoconductor and is responsible for the photosensitive function such as increase in electrical conductivity during the light exposure in the field of the electrophotography. The photoconductor is generally formed by laminating photoconductive insulating layer approximately 5–200 μm in thickness on an electrically conductive substrate to form a photoconductor. In this case, the electrically conductive substrate acts as an electrode in the photoconductor. In the case of using the step of toner-image transfer in the process of image formation, it is important that the electric properties of the photosensitive layer should be kept at a constant all the times in spite of after repeating the steps of discharge, exposure, development, image-transfer, and cleaning.

Taking a mechanical strength of the photoconductor in consideration with the above maters, therefore, the conventional photoconductors have been mainly prepared by inorganic photoconductive materials such as selenium, selenium alloys, zinc oxide, and cadmium sulfate. In recent years, however, there have been much more studies for using organic photoconductive materials by virtue of their advantageous features for preparing a light-weighted flexible layer cost effectively without causing any toxic effects.

Furthermore, the photosensitive layer of the photoconductor has been classified into two types in general. That is, one is formed as a single layer (hereinafter, referred as a mono-type photosensitive layer) and the other is formed as a laminate of layers which are functionally distinguishable (hereinafter referred as a laminate-type photosensitive layer). The laminate-type photosensitive layer comprises a lower layer for the function of generating charge carriers and an upper layer for the function of transporting the charge carriers. These layers are easily prepared and modified by selectively using appropriate raw materials to improve their physical properties such as photosensitivity against specific wavelength of illuminated light and sensitivities against the spectrum according to the range of wavelengths of the illuminated light.

Accordingly, the laminate-type photosensitive layers have been much more studied that the mono-type one and used in many kinds of the electrophotographic devices such as photocopying machines, facsimile machines, and printers.

More recently, there have been much demands for miniaturizing the electrophotographic devices and also for increasing their printing speeds. For replying to these demands, the miniaturized devices should be manufactured so as to keep their abilities of providing good image qualities by forming the image at the same speed or at the higher speed compared with that of those currently in use. In this case, therefore, it is also necessary to miniaturize a drum of the miniaturized device on which the photoconductor will be mounted.

For performing the printing and coping at least at the same speed as that of those currently in use, the small-sized drum must rotate at a higher rate compared with the conventional one.

In the miniaturized device, accordingly, the photoconductor provided on the small-sized drum can be used more frequently than that of the conventional one, so that the photoconductor to be installed in the miniaturized device should be improved so as to have a high durability against repetitive usage and a good respond sensitivity to the illuminated light.

Several photoconductors have been proposed in order to reply these demands. Most of them include more than one layer in their photosensitive layer portions. That is, the photosensitive layer has functionally distinguishable layers: one contributes to generate an electric charge by absorbing illuminated light; and the other contributes to transport the electric charge. The charge generation layer mainly includes a charge-generating material, while the charge transport layer mainly includes a charge-transporting material. Besides the charge-transporting material, the charge transport layer optionally includes a binder or a stabilizer, or both. The binder is responsible for forming a membrane structure while the stabilizer is responsible for stabilizing the membrane structure by arresting the progress of oxidation to be caused by ultraviolet light, ozone, or the like.

Japanese Patent Application Publication No. 55-42380 discloses a photoconductor that has functionally distinguishable layers, a charge generation layer and a charge transport layer, and in this case the farmer includes Chlorodiane Blue as a charge-generating material and the latter includes a Hydrazone compound as a charge-transporting material. Both the response rate of the photoconductor and its durability to last tens of thousands of cycles of the image formation are mainly depended on the nature of the charge transport layer. Accordingly, several materials have been proposed as a raw material for preparing the charge transport material, for example Pyrazorine derivatives (the Journal of Photographic Science and Engineering vol. 21, No. 2, page 73, 1977); Enamine derivatives (the Journal of Imaging Science vol. 29., No. 1, page 7, 1985 and Japanese Patent Application Laying-Open No. 63-170651); and Benzidine derivatives (Japanese Patent Application Laying-Open No. 3-43744 and Japanese Patent Application Laying-Open No. 59-9049). In spite of these investigations, however, these charge-generating materials do not satisfy the request of providing the photoconductors with both an excellent durability to the repetitive usage and a good response speed to the illuminated light.

Consequently, a photoconductor practically used at the present time is generally in the type of organic photoconductor that has functionally distinguishable layers: a charge generation layer and a charge transport layer which are laminated on an electrically conductive substrate in that order. The photoconductor is prepared by the process including the steps of: performing sublimation or vapor deposition of the organic charge-generating material on the electrically conductive substrate, or applying and drying a coating solution prepared by dispersing and dissolving with a binder in an organic solvent on the electrically conductive substrate to form the charge generation layer; and applying and drying another coating solution prepared by dispersing and dissolving a charge-transporting material with a binder in an organic solvent on the charge generation layer to form the charge transport layer. The photoconductor that has the laminate structure thus obtained is enough to perform the process of image formation. In the practical use, however, it is important to form images without any defects and also it is important to keep good image qualities during the period of repeating the usage. Therefore the photoconductor should be formed as a uniform structure without any defects to obtain stable electric properties thereof and sufficient durability to last of tens of thousands of cycles of the image formation.

By the way, the function of the charge generation layer is to absorb the illuminated light and generate electron carriers. These electron carriers move quickly to both the electrically conductive substrate and the charge transport layer. It is required that the charge generation layer does not trap free carriers during their movements for injecting them into the electrically conductive substrate and the charge transport layer. Therefore, it is preferable that the charge generation layer is formed as thin as possible. The charge generation layer used in the conventional photoconductor is generally formed as a thin film with a thickness of in the order of sub microns, so that the charge generation layer is easily affected by troubles on a surface of the electrically conductive substrate, such as unstable electric properties, an irregular shape, impurities, and roughness thereof. However it is difficult to make the substrate without causing the troubles described above. Consequently these troubles affect the photosensitive layer to deteriorate the image qualities by causing whiteness of non-imaged areas and blackness and non uniform appearance of the imaged areas in the copy.

In general, the electrically conductive substrate is formed as a drawn cylindrical tube of aluminum alloy, or a cylindrical tube having a surface smoothed by means of cutting, grinding and polishing, but it is difficult to avoid the troubles described above.

Up to the present time, the conventional photoconductor has been modified by providing an intermediate layer between the photosensitive layer and the electrically conductive substrate for obtaining a smooth and uniform surface of the charge generation layer and also for suppressing the deterioration of charge-holding properties of the photoconductor. The deterioration can be caused by injecting holes (which are required for converting light to electron-hole pairs) from the electrically conductive substrate to the photosensitive layer. In this case, the intermediate layer is typically made of an N-type resin having a low electric resistance, such s solvent-soluble polyamide, polyvinyl alcohol, polyvinyl butyral, and casein. Only for suppressing the deterioration of charge-holding properties of the photoconductor, the intermediate layer can be formed as thin as possible by using one of the N-type resins for the intermediate layer. For example, the effective intermediate layer can be formed so as to have a thickness of 0.1 μm or under, but thick enough to make a uniform surface of the charge generation layer for covering the rough or contaminated surface of the electrically conductive substrate without causing non uniform distribution of the coating solution of the charge generation layer. Consequently, the intermediate layer should be formed so as to have a thickness of at least 0.5 μm, or preferably 1 μm or over if required.

However, the thin resin layer formed by using one of the resins described above rises the residual potential and changes the electric properties of the photoconductor under the environmental condition of at a low temperature and a low humidity or at a high temperature and as high humidity.

These troubles are due to the changes of electric resistance of the resin layer because these changes are depended on the moisture content of the resin layer that has an affinity for moisture (i.e., hygroscopic properties) and the absorbed water molecules in the resin dissociate into hydrogen ions and hydroxyl ions. These ions are responsible for the ionic conductance which occupies the greater part of the electroconductance.

It has been proposed that a polyamide resin is one of the suitable raw materials for preparing the intermediate layer. In spite of its thickness, for that reason, it has a low electric resistance thereof. The resistance is only slightly changed when its environmental condition is changed. In the case of solvent-soluble polyamide resins which can be used as suitable raw materials, for example, their structures are specified in the documents of Japanese Patent Application Laying-Open No. 2-193152; Japanese Patent Application Laying-Open No. 3-288157; Japanese Patent Application Laying-Open No. 4-31870; and others. In addition, several other documents such as Japanese Patent Application Publication No. 2-59458, Japanese Patent Laying-Open No. 3-150572, and Japanese Patent Application Laying-Open No. 2-53070 disclose that the changes of electric resistance due to the environmental changes are limited by adding an appropriate additive to the polyamide resin. Furthermore, Japanese Patent Application Laying-Open No. 3-145652, Japanese Patent Application Laying-Open No. 3-81778, Japanese Patent Application Laying-Open No. 2-281262, and other documents disclose mixtures of polyamide resin and another kind of resin for adjusting the electric resistance to protect the layer form the effects of the changes of the environmental conditions. However, the intermediate layer comprises the polyamide resin as one of the main components so that the electric properties of the layer can be influenced by a degree of temperature and humidity in the surroundings.

In addition to the polyamide resin, several materials have been proposed as a raw material of the intermediate layer, such as cellulose derivatives (Japanese Patent Application Laying-Open No. 2-238459); polyether urethane (Japanese Patent Application Laying-Open No. 2-115858, Japanese Patent Application Laying-Open No. 2-280170); polyvinyl pyrolidone (Japanese Patent Application Laying-Open No. 2-105349) and polyglycol ether (Japanese Patent Application Laying-Open No. 2-79859).

For keeping a moisture content in the resin layer at a constant against the surroundings, a cross-linking resin has been also proposed as a raw material of the intermediate layer, such as melamine resin (Japanese Patent Application Laying-Open No. 4-22966, Japanese Patent Application Publication No. 4-31576, and Japanese Patent Application Publication No. 4-31577) and phenol resin (Japanese Patent Application Laying-Open 3-48256). The intermediate layer formed by using one of the materials described above is useful when it is formed as an extremely thin film. However, the resistance of the photoconductor, which is the cause of increasing the residual potential, can be increased when it is formed as comparatively a thick film with a thickness of in the order of several μm.

One of the ways for eliminating the problems described above to form the intermediate layer is to use a material having an electric conductivity in the type of electronic conduction instead of ionic one. For this purpose, Japanese Patent Application Publications No. 1-51185, 2-48175, 2-60177 and 2-62861 propose the processes in which the intermediate layers are formed by dispersing the electrically conductive powders such as tin oxide and indium oxide in the resin. In spite of these proposals, however, it is difficult to make a uniform dispersion of the electrically conductive particles in the resin solution to be applied on the conductive layer. Furthermore, the resin solution comprising the particles cannot store well because they are easily segregated and settle to the bottom in the solution, so that the particles tend to protrude as minute projections from a surface of the applied solution during the step of forming the intermediate layer on the conductive substrate. In this case, the intermediate layer with a rough surface can be obtained and the image qualities of the photoconductor can be deteriorated. For improving the image qualities, organic metal compounds are used instead of the above electrically conductive particles. For example, Japanese Patent Application Publication No. 3-4904 and Japanese Patent Application Laying-Open No. 2-59767 disclose the steps of forming the intermediate layer by applying the solution prepared by dissolving the organic metallic compounds and the resin in the organic solvent, nevertheless the solution is not stable enough to provide a uniform surface of the layer. Consequently there are many problems to be solved for producing the photoconductors on a large scale.

SUMMARY OF THE INVENTION

An object of the present invention is to provide a photoconductor for electrophotography that has excellent electric properties and image qualities without causing any troubles by the environmental condition; and an increased productivity on a large scale.

There is provided an electrophotographic photoconductor comprising:

an electrically conductive substrate;

a photosensitive layer formed on the electrically conductive substrate; and an intermediate layer formed between the electrically conductive substrate and the photosensitive layer, wherein the intermediate layer is made of a hardened film comprising an amino resin.

Here, the hardened film may be formed by hardening the amino resin with a catalyst comprising at least one acid selected from a group of organic and inorganic acids and latent acids thereof.

The organic acid may be selected from a group of aromaticsulfonic acid, alicyclicsulfonic acid, and mixtures thereof.

The amino resin may be a compound selected from a butylated urea resin, a butylated melamine resin, a butylated benzoquanamine resin, and a butylated benzoguanamine resin, and a butylated benzoguanamine co-polymer resin, which is prepared by reacting alcohol with a methylol compound obtained by a reaction between formaldehyde and a compound selected from a group of urea compounds including dicyandiamide, urea, and thiourea and triazine compounds including melamine, isomelamine, benzoguanamine, and acetoguanamine.

The aromaticsulfonic acid and the alicyclicsulfonic acid may be compounds in which sulfonic groups are directly bound to aromatic and alicyclic group, respectively, and selected from a group of benzenesulfonic acid, paratoluenesulfonic acid, 2-naphthalenesulfonic acid, dodecylbenzenesulfonic acid, dinonylnaphthalenesulfonic acid, dinonylnaphthalenedisulfonic acid, camphasulfonic acid, anthraquinone-1,5-disulfonic acid, anthraquinone-2,6-disulfonic acid, anthraquinone-2-sulfonic acid, and derivatives thereof in which aromatic and alicyclic groups are bound to one of aryl, alkyl, and aralkyl groups.

The intermediate layer may comprise:

5–100 parts by weight of the organic acid selected from a group of aromaticsulfonic acid, alicyclicsulfonic acid, and a mixture thereof with respect to 100 parts by weight of the amino resin.

The inorganic acid may be selected from a group of hydrochloric acid, hydrofluoric acid, hydrobromic acid, sulfuric acid, phosphoric acid, and boric acid; and the inorganic acid is comprised in the catalyst with or without the organic salt.

The organic acid may be comprised in the catalyst with a second organic acid selected from a group of acetic acid, oxalic acid, succinic acid, adipic acid, benzoic acid, 2-naphthalincarbocylic acid, orthofutalic acid, isofutalic acid, trimellitic acid, pyromellitic acid, maleic acid, fumaric acid, itaconic acid, linolic acid, endomethylene tetrahydrophtalic acid, and latent acids thereof, with or without the inorganic acid.

The catalyst may comprise:

0.1–10 mol of an acid selected from the second organic acid, the inorganic acid, and a mixture thereof with respect to 1 mol of the organic acid selected from a group of aromatic sulfonic acid, alicyclic sulfonic acid, and mixtures thereof.

The intermediate layer may further include a compound selected from a group of iodine, ferric chrolide, and a mixture thereof.

The intermediate layer may further include a compound selected from a group of alkyd resin and phenol resin.

The intermediate layer may further include a filler selected from a group of titanium oxide, aluminum oxide, kaolin, talc, and silicon oxide.

The photosensitive layer may be in the type of having functionally distinguishable layers and may be composed of a charge generation layer and a charge transport layer.

The charge generation layer may include at least one charge-generating material selected from a group of: inorganic charge-generating materials including selenium-tellurium and selenium-arsenic; organic charge-generating materials including azo pigment, disazo pigment, perynon pigment, perylene pigment, anthanthrone pigment, phtalocyanine pigment, pyrylium pigment, and squaraines pigment.

The charge transport layer may be composed of:

a compound selected from a group of indole derivatives, enamine compounds, amine compounds, hydrazone compounds, styryl compounds, butadiene compounds, triphenylmethane compounds, and pirazoline compounds; and a binder resin which is mutually soluble to the compound, preferably selected from a group of polycarbonate resin, polystyrene resin, styrene resin, and acrylate resin.

The electrically conductive substrate may be made of a material selected from: non-conductive materials having a surface treated to be electrically conductive by a treatment selected from a metal deposition, a metal plating, and an application of an electrically conductive paint, including plastic, paper, carbon powder dispersed plastics and glass; and conductive materials including iron, nickel, and aluminum.

The above and other objects, effects, features and advantages of the present invention will become ore apparent from the following description of embodiments thereof taken in conjunction with the accompanying drawings.

DETAILED DESCRIPTION OF PREFERRED EMBODIMENTS

Figure 1:
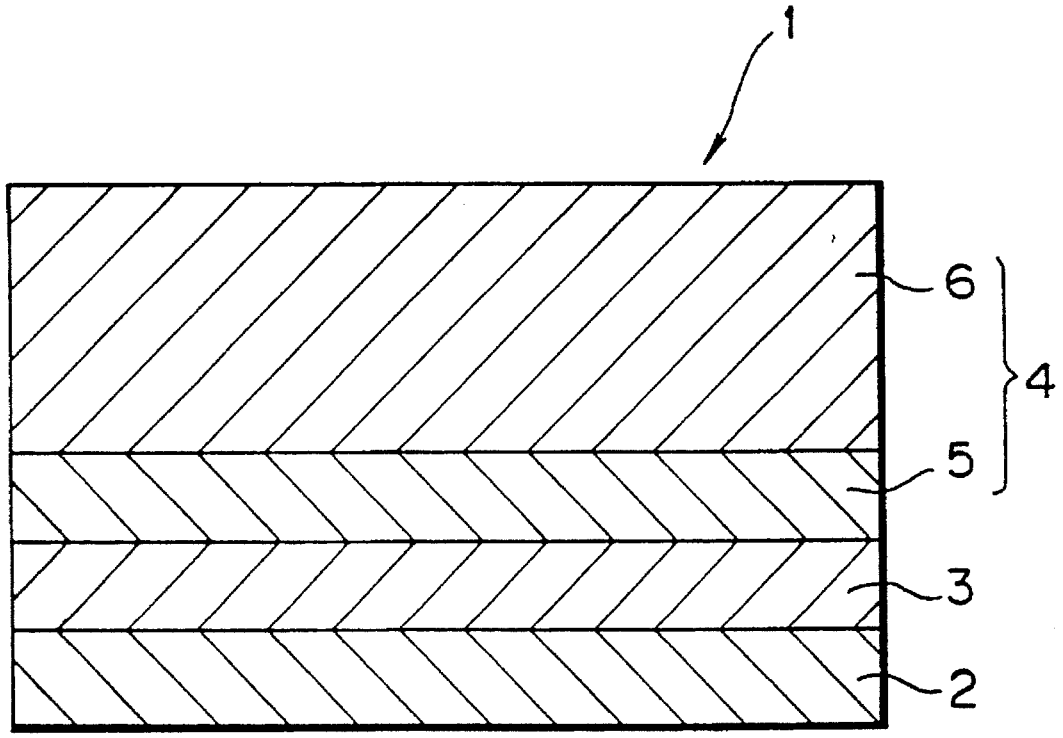
FIG. 1 shows a cross sectional plan view of a photoconductor for electrophotography in accordance with the present invention.

As shown in FIG. 1, a photoconductor 1 as one of the preferred embodiment of the present invention is in the type that a photosensitive layer 4 is consisted of different layers (i.e., a charge generation layer 5 and a charge transport layer 6) which are functionally distinguishable. Therefore the photoconductor 1 has a laminate structure in which an intermediate layer 3, the charge generation layer 5, and the charge transport layer 6 are laminated on an electrically conductive substrate 2 in that order. It is noted that the present invention is not limited in the laminate type as described above but also it is possible to provide a photoconductor in the type of mono-layer in which a photosensitive layer is not divided into two portions.

The electrically conductive substrate 2 serves as an electrode of the photoconductor 1 and as a support for other layers 3, 5, and 6 formed thereon. Also, the electrically conductive substrate 2 may be in the form of a cylinder, a plate, or a film, and also may be made of a metallic material such as aluminum, stainless steel, nickel, or the like; or other material such as plastics, glass, paper, or the like that has a surface treated to be electrically conductive by means of metallization, metal plating, electrically conductive coating, or the like for example carbon powder dispersed plastics.

The charge generation layer 5 includes a charge-generating material select from: inorganic charge-generating materials such as selenium-tellurium, and selenium-arsenic; and organic charge-generating materials such as azo pigment, squaraines pigment, pyrylium pigment, perylene pigment, anthanthrone pigment, phtalocyanine pigment, and titanylphthalocyanine pigment, but not limited to those materials.

A predetermined amount of the charge-generating material is provided into a layer on the electrically conductive substrate by means of vacuum evaporation or applying and drying a dispersion of the charge-generating material in a solvent with or without a resin binder on the substrate.

The resin binder to be included in the charge generation layer is selected from any materials which can be easily formed as electrical-insulating films and fit to the layer formation, for example polyvinyl resin (such as polyvinyl formal, polyvinyl acetal and polyvinyl butyral); acrylic resin; polyester resin; polycarbonate resin; vinyl chloride copolymerized resin; vinyl-acetate copolymerized resin; and silicone resin. It is preferable to use 10 to 300 weight % of the resin binder per a total volume of the charge generation layer. In addition to the resin binder, an additional agent can be further included in the charge generation layer if required, for example a plasticizer (such as paraffin halide) and a pin-hole preventive agent (such as dimethyl phthalate).

The charge generation layer is prepared as follows.

The charge-generating material selected from the inorganic or organic materials described above is applied on the electrically conductive substrate by means of vacuum deposition to form a layer 0.01–1 μm in thickness. Alternatively, it is prepared by applying the solution including the resin binder or the additional agent described above, or both by means of using sand mill, atritor, paint shaker or the like with the method of spray coating, dip coating or the like to form a layer 0.01–3 μm in dry thickness.

The charge transport layer 6 is made of a charge transport material selected from a group of amine compounds, hydrazone compounds, styryl compounds, butadiene compounds, enamine compounds, diamine compounds, benzidine compounds, tryphenylmethane compounds, pyrazoline compounds, and indole derivatives disclosed in the U.S. patent application Ser. No. 08/05,988. Also, the charge transport layer is prepared by the steps of: dissolving the charge-transporting material with a resin binder in a solvent to make a coating solution; applying the coating solution on the electrically conductive substrate; and drying the coating solution to form a layer 5–40 μm in thickness. The resin binder usable in the charge transport layer can be selected from a group of polycarbonate resin, polyester resin, acrylic resin, styrene resin, and the like but not limited to these resins.

The intermediate layer 3 is made of a hardened membrane prepared by hardening an amino resin as a main component with a catalyst containing aromatic sulfonic acid and/or alicyclic sulfonic acid. According to this specified formula, the intermediate layer provides a photoconductor with excellent electric properties compared with the conventional one prepared by hardening the amino resin with the other kind of acids. That is, the intermediate layer 3 of the present invention is stable under the environmental changes and its residual potential takes comparatively a low value whatever the layer has a large thickness, for example 10–20 μm. According to the present invention, in addition, troubles such as increasing of the residual potential and decreasing of charging properties of the intermediate layer cannot be observed after repeating the cycles of image formation. Furthermore, the photoconductor of the present invention shows excellent electric properties of providing good image qualities without causing any troubles by the surroundings (for example at high temperature and humidity or low temperature and humidity) during the period of repeating the cycles of image formation.

The amino resin mentioned above is prepared as follows. That is, a urea compound selected from dicyanic diamide, urea, thiourea, and the like or a triazine compound selected from melamine, isomelamine, benzoguanamine, acetoguanamine and the like is reacted with formaldehyde to obtain a methyrol compound. The methyrol compound is further treated with butanol, isobutanol, or the like to obtain a butyl etherated compound which can be used alone or as a mixture or a co-condensed compound.

The aromaticsulfonic acid or alicyclicsulfonic acid is a compound in which sulfonic group is directly bound to aromatic or alicyclic group, for example benzenesulfonic acid, para-toruensulfonic acid, 2-naphthalenesulfonic acid, dodecylbenzene sulfonic acid, dinonylnaphthalenesulfonic acid, dinonylnaphthalenedisulfonic acid, camphasulfonic acid, anthraquinone-1,5-disulfonic acid, anthraquinone-2,6-disulfonic acid, and anthraquinone-2-sulfonic acid. In addition, derivatives that have aromatic or alicyclic group with aryl, alkyl, or aralkyl group can be also used.

These compounds of sulfonic acid act as a catalyst for hardening the amino resin and also they improve an electrical conductivity of the amino resin.

The amount of the sulfonic acid enough to harden the amino resin is depended on types of the amino resin and the sulfonic acid to be used, but in general 5–10 weight % of the sulfonic acid with respect to 100 weight % of the amino resin is preferably used. In the case of preparing the intermediate layer by using under 5 weight % of the sulfonic acid, the amino resin cannot be hardened sufficiently because the coating solution to be formed as a charge generation layer is absorbed into the intermediate layer. Consequently, the intermediate layer thus obtained does not show a low electrical conductivity. In the case of preparing the intermediate layer by using over 5 weight % of the sulfonic acid, on the other hand, the intermediate layer cannot be formed as a smooth and uniform membrane because it becomes too hard.

In this invention, the specified compounds of sulfonic acid described above are used as a catalyst for hardening the amino resin. However, these compounds can be also used as one in the form of a latent acid such as amine salt and ammonium salt.

Furthermore, it is possible to mix the sulfonic acid compound described above with an additional compound that has been known as a catalyst for hardening the amino resin. Such additional compound can be selected from inorganic acids, organic acids, and latent acids thereof such as amine salt and ammonium salt. Accordingly, a hardness of the intermediate layer is arbitrarily assigned by shifting the hardening rate or the cross-linking rate of the amino resin by selecting the type and the amount of acid to be added. The inorganic acid can be selected from a group of hydrochloric acid, hydrofluoric acid, hydrobromic acid, sulfuric acid, phosphoric acid, boric acid, and latent acids thereof. Also the organic acid can be selected from acetic acid, oxalic acid, succinic acid, adipic acid, benzoic acid, 2-naphthalenecarboxylic acid, orthophthalic acid, isophthalic acid, trimellitic acid, pyromellitic acid, maleic acid, fumaric acid, iraconic acid, linolic acid, endomethylene tetrahydrophtalic acid, acid anhydrides thereof, and latent acids thereof such as amine salt and ammonium salt. These inorganic and organic acids can be used individually or as a mixture thereof. It is preferable that the catalyst comprises 0.1–10 mol of the additional compounds with respect to 1 mol of the sulfonic acid. When the amount of the additional compounds is under 0.1 mol, the hardness of the coated layer is lowered. When the amount of the additional compounds is over 10 mol, the sulfonic acid does not effect on the layer well and increases the residual potential of the photoconductor.

These specified sulfonic acids not only act as a catalyst for hardening the amino resin but also act as one for lowering a resistance of the applied solution. Furthermore, the resistance can be further decreased by adding an agent such as iodine or ferric chloride. Therefore the amount of the sulfonic acid can be comparatively lowered by adding such agent and thus physical properties of the membrane obtained by hardening the amino resin such as adhesive properties, hardness, strength, and resistance to solvents can be improved.

Furthermore, the intermediate layer may further include alkyd resin, phenol resin, or the like to improve a strength of adhesion between the substrate and the intermediate layer, between the charge generation layer and the intermediate layer, or between the intermediate layer and a blocking layer if required. The blocking layer is a thin film mainly comprising polyamide resin which is soluble in alcohol. The blocking layer is provided between the intermediate layer and the charge generation layer. The phenol resin mentioned above may be included as a resol type which is prepared by condensing phenol with excess formaldehyde.

The intermediate layer may further comprise a filler for avoiding a generation of drips of the applied solution on the substrate, and also for avoiding a generation of moire on the image as a result of reflecting the light from the substrate when the intermediate layer is prepared for the photoconductor used in the electrophotography using coherent light for the exposure. In this case, the filler can be selected from several compounds such as titanium oxide, aluminum oxide, kaolin, talc, and silicon oxide.

According to the present invention, the intermediate layer is formed as follows. A mixture of indispensable main components (i.e., amino resin, aromaticsulfonic acid and/or alicyclicsulfonic acid) and various materials described above is dissolved and dispersed in an appropriate solvent such as a mixture of butanol and xylol; tetrahydrofuran; and methanol to prepare a coating solution. The coating solution is applied on the electrically conductive substrate by means of splay coating, dip coating or the like, and then the coating solution is heated so as to make a sufficient hardening of the solution to be formed as a membrane. In general, the heating is performed at a temperature of 80°–150° C., preferably 120°–130° C., for 20–60 minutes.

The intermediate layer thus obtained has a sufficient low electric resistance which is hardly ever effected by changing the surroundings at high temperature and humidity or at low temperature and humidity. Therefore, the electric properties of the intermediate layer can be hardly ever effected at all in all cases whatever it is formed as a thick layer (e.g., 10–20 μm in thickness) and used over and over. That is, for example the electric properties such as charge potential, photosensitivity, and residual potential of the photoconductor do not be effected by the repetitive usage. In addition, many inhomogeneous, shape-defective, rough, and impure regions formed on the surface of the photoconductive substrate can be covered with the intermediate layer so that the photosensitive layer can be formed so as to reduce membrane defects and make it uniform throughout. In the case of the photoconductor of the functionally deviated layer type, in which the photosensitive layer is formed by laminating the charge transport layer on the charge generation layer, the charge generation layer can be easily formed as a thin film which is uniform throughout. Consequently the photoconductor for constantly providing excellent image qualities can be obtained, and also it is very rare to provide the images having defects.

According to the present invention, as stated above, a preferable photoconductor has functionally distinguished layers in which a charge generation layer and a charge transport layer are laminated on an electrically conductive substrate in that order. In the photoconductor, the charge generation layer is formed as a coated film with a thickness of 0.1–1 μm by drying a coating solution on the intermediate layer described above. The coating solution is prepared by dispersing a pigment selected from phtalocyanine pigment, anthanthrone pigment, perynon pigment, perylen pigment, azo pigment, disazo pigment, and so on in an appropriate binder resin. Then the charge transport layer is formed on the charge generation layer having a thickness of 5–40 μm by applying and drying a solution prepared by dissolving a binder resin such as polycarbonate, polyester, polystyrene, or styrene acrylate, which is well-suited with a material selected from a group of amine compounds, hydrazone compounds, enamine compounds, and so on.

The amino resin mentioned above is prepared as follows. That is, urea, melamine, isomelamine, benzoquanamine, acetoguanamine or the like is mixed with an excess formaldehyde. The obtained mixture is treated with methylol and is subjected to a methylene condensation in a large amount of butanol in the presence of alkali catalyst. The condensed compound is further treated with butyl ether to obtain the amino resin. In this case, the degree of the condensation is varied according to the amount of the excess formaldehyde and a strength of the alkali catalyst. In general, the condensed compound of about 2,000–4,000 average molecular weight can be obtained. When the reaction is performed in the presence of only acidic catalyst, on the other hand, the condensed compound of amount 1,000 average molecular weight can be obtained.

The amino resins to be obtained by the process described above have been well known as butylated urea resin, butylated melamine resin, butylated benzoquanamine resin, and co-condensed resin between butylated melamine and benzoguanamine. These resins are commercially available, for example "Uban" (trademark, manufactured by Mitsui Toatsu Chemicals Co., Ltd.) and "Super Bekamine" (trademark, manufactured by Dai Nippon Ink Chemical Industrials Co., Ltd.).

<Examples 1–11>

Following materials were used for preparing the intermediate layer.

(1) Amino resin

Sample A-1: Melamine resin which was prepared as follows.

A reaction mixture of melamine (126 g), n-butanol (400 g), paraformaldehyde (150 g), and 1NHCl solution (0.3 g) was dehydrated by reflux for 2 hours at 100° C. and n-butanol was distilled off, resulting that a resin solution with 50 weight % solidified portion was obtained and referred as a sample A-1 (according to the analysis, the number-average molecular weight 1500, methyrol group 1.7, and butylether group 2.0).

Sample A-2: Uban 20 (trademark) manufactured by Mitsui Toatsu Chemicals Co., Ltd.

Sample A-3: Uban 91-55 (trademark) manufactured by Mitsui Toatsu Chemicals Co., Ltd.

Sample A-4: Supper Beckamine TD-126 (trademark) manufactured by Dai Nippon Ink Chemical Industrials Co., Ltd.

Sample A-5: Beckamine P-138 (trademark) manufactured by Dai Nippon Ink Chemical Industrials Co., Ltd.

(2) Aromaticsulfonic acid or alicyclicsulfonic acid

Sample B-1: dinonylnaphthalenedisulfonic acid

Sample B-2: dinonylnaphthalenedisulfonic acid ammonium salt

Sample B-3: dodecylbenzenesulfonic acid

Sample B-4: camphasulfonic acid (3) Acids except sulfonic acid

Sample C-1: phosphoric acid

Sample C-2: ammonium chloride

Sample C-3: trimellitic anhydride

Sample C-4: itaconic acid

Sample C-5: maleic anhydride

Sample C-6: ammonium phthalate (4) Agents for lowering the resistance

Sample D-1: iodine

Sample D-2: ferric chloride

An intermediate layer was formed on an aluminum cylinder (30 mm outer diameter, 28 mm inner diameter, 260.5 mm length) with a surface roughness of $R_{max}$=1.0 mm. Then the aluminum cylinder was treated with one of the coating solution T-1–T-11 which were prepared from the samples A-1–A-5, samples B-1–B-4, samples C-1–C-6, and samples D1 and D-2, as shown in Table 1 below, by the method of dip coating. The solution applied on the cylinder was subjected to a sintering process for hardening the solution to make the intermediate layer under one of the conditions in Table 2 below. The intermediate layers U-1–U-11 as listed in Table 2. Each value of the concentration in Table 1 was calculated as a proportion in relation to the solvent which is a mixture of toluene and butanol (50:50).

<Comparative Examples 1–2>

The intermediate layers u-1 and u-2 were prepared by the same method as that of the examples 1–11, excepting their composition of the coating solution t-1 and t-2, as shown in Table 1 below. That is, each intermediate layer was prepared by the steps of treating a surface of the aluminum cylinder with one of the coating solutions (t-1 or t-2) by the method of dip coating and dried, and subjecting the surface to a sintering process for hardening the solution to make an intermediate layer u-1 or u-2, under the condition shown in Table 2 below.

TABLE 1

| | Composition (parts by weight) | | | | |
|---|---|---|---|---|---|
| Solution No. | Amino resin | Sulfonic acid | Other acid | Agent Conc. | (%) |
| T-1 | A-1 (100) | B-1 (20) | | | 50 |
| T-2 | A-1 (100) | B-2 (25) | | | 50 |
| T-3 | A-3 (100) | B-3 (30) | | | 50 |
| T-4 | A-2 (100) | B-4 (30) | C-1 (5) | | 50 |
| T-5 | A-2 (100) | B-2 (25) | C-2 (5) | | 50 |
| T-6 | A-2 (100) | B-1 (10) | C-3 (10) | | 50 |
| T-7 | A-2 (100) | B-2 (10) | C-6 (10) | | 50 |
| T-8 | A-2 (100) | B-3 (10) | | D-1 (5) | 30 |
| T-9 | A-2 (100) | B-1 (5) | C-5 (10) | D-1 (5) | 30 |
| T-10 | A-2 (100) | B-1 (5) | C-5 (10) | D-2 (5) | 30 |
| T-11 | A-2 (100) | B-1 (5) | C-4 (10) | D-1/D-2 (5/5) | 40 |
| t-1 | A-2 (100) | phthalic acid (20) | | | 30 |
| t-2 | A-3 (100) | acid (20) | | trimellic | 50 |

TABLE 2

| Intermediate layer No. | Hardening condition | Membrane thickness (μm) |
|---|---|---|
| U-1 | 130° C. × 2 hours | 10 |
| U-2 | " | 15 |
| U-3 | " | 20 |
| U-4 | " | 20 |

TABLE 2-continued

| Intermediate layer No. | Hardening condition | Membrane thickness (μm) |
|---|---|---|
| U-5 | " | 15 |
| U-6 | 100° C. × 1 hour | 10 |
| U-7 | 140° C. × 1 hour | 10 |
| U-8 | 130° C. × 2 hours | 15 |
| U-9 | " | 20 |
| U-10 | " | 10 |
| U-11 | " | 10 |
| u-1 | " | 15 |
| u-2 | " | 15 |

The photoconductor was prepared as follows.

The aluminum cylinder having the intermediate layer described above was dipped into a solution prepared by dispersing the following compounds by paint shaker to form a charge generation layer of 0.2 μm in dried thickness.

The compounds were 1 parts by weight of X-type non-metal phthalocyanine which was commercially available as "Fastogen Blue 8120 B" (trade mark, manufactured by Dai Nippon Ink Chemical Industrials Co. Ltd.);

1 parts by weight of co-polymerized vinyl chloride resin commercially available as "MR-110" (trademark, manufactured by Nippon Zeon Co., Ltd.); and 100 parts by weight of methylene chloride.

Furthermore, the aluminum cylinder is dipped into a solution prepared by dissolving 10 parts by weight of polycarbonate resin commercially available as "Iupiron PCZ-300" (trademark, manufactured by Mitsubishi Gas Chemicals Co., Ltd.) and 10 parts by weight of N, N-diethylaminobenzoaldehydediphenylhydrazone in 80 parts by weight of tetrahydrofuran to obtain a charge transport layer of 20 μm in dry thickness, resulting that each photoconductor of Examples 1–11 and Comparative examples 1 and 2 was obtained.

The electrophotographic properties of the each photoconductor was evaluated by using a process-examination device for photoconductors. The photoconductor was placed in the device as a sample. The sample was negatively charged by corotoron at −600 v and then it was rotated at a peripheral speed of 78.5 m/second. Initial potential ($V_0$) was defined as a level of potential at an initial period in the absence of light. The sample was left in dark for 5 seconds, and then a rate of the potential at an initial period in the absence of light. The sample was left in dark for 5 seconds, and then a rate of the potential retention ($V_{ks}$(%)) was calculated by measuring potentials during the period. Bright potential ($V_i$) was defined as a level of potential at 0.2 seconds after starting the irradiation with light of a wavelength of 780 nm and a luminous flux density of 2 μW/cm$^2$. Furthermore residual potential ($V_r$) was defined as a potential measured after the irradiation for 1.5 seconds. The process including the charging and the development was repeated 10,000 times. Electric properties of the photoconductor at the initial stage and at the stage of repeating the process 10,000 times were listed in Table 3.

TABLE 3

| | Initial | | | | After 10,000 repetitions | | | |
|---|---|---|---|---|---|---|---|---|
| No. | $V_0$ (V) | $V_{k5}$ (%) | $V_i$ (V) | $V_r$ (V) | $V_0$ (V) | $V_{k5}$ (%) | $V_i$ (V) | $V_r$ (V) |
| Exp. 1 | −650 | 89 | −50 | −20 | −640 | 87 | −70 | −25 |
| Exp. 2 | −670 | 88 | −52 | −25 | −650 | 92 | −80 | −36 |
| Exp. 3 | −650 | 84 | −49 | −30 | −630 | 89 | −71 | −34 |
| Exp. 4 | −660 | 89 | −49 | −35 | −650 | 94 | −74 | −40 |
| Exp. 5 | −630 | 87 | −40 | −10 | −610 | 93 | −49 | −21 |
| Exp. 6 | −650 | 90 | −50 | −25 | −640 | 89 | −60 | −30 |
| Exp. 7 | −640 | 91 | −56 | −28 | −630 | 90 | −59 | −30 |
| Exp. 8 | −620 | 92 | −51 | −10 | −600 | 90 | −55 | −18 |
| Exp. 9 | −600 | 89 | −49 | −8 | −590 | 88 | −56 | −20 |
| Exp. 10 | −610 | 88 | −48 | −6 | −600 | 87 | −52 | −16 |
| Exp. 11 | −600 | 89 | −46 | −9 | −580 | 87 | −56 | −17 |
| Comp. 1 | −670 | 87 | −100 | −80 | −600 | 95 | −140 | −120 |
| Comp. 2 | −650 | 89 | −120 | −100 | −600 | 90 | −160 | −140 |

From the results listed in Table 3, the intermediate layers of Comparative Examples 1 and 2, which do not comprise the sulfonic acid in their intermediate layer, show high residual potentials and poor abilities of maintaining their electric properties during the repetitive usage.

Furthermore, characteristic changes of the photoconductor were observed under the circumstances of: high temperature and humidity (H.H: 35° C., 85% RH); and low temperature and humidity (L.L: 10° C., 50% RH). The results were listed in Table 4.

TABLE 4

| | L.L | | | | H.H | | | |
|---|---|---|---|---|---|---|---|---|
| No. | $V_0$ (V) | $V_{k5}$ (%) | $V_i$ (V) | $V_r$ (V) | $V_0$ (V) | $V_{k5}$ (%) | $V_i$ (V) | $V_r$ (V) |
| Exp. 1 | −660 | 91 | −100 | −40 | −640 | 90 | −50 | −20 |
| Exp. 2 | −685 | 92 | −90 | −45 | −645 | 89 | −60 | −32 |

TABLE 4-continued

| | L.L | | | | H.H | | | |
|---|---|---|---|---|---|---|---|---|
| No. | $V_0$ (V) | $V_{k5}$ (%) | $V_i$ (V) | $V_r$ (V) | $V_0$ (V) | $V_{k5}$ (%) | $V_i$ (V) | $V_r$ (V) |
| Exp. 3 | −670 | 93 | −97 | −38 | −635 | 88 | −50 | −30 |
| Exp. 4 | −680 | 90 | −102 | −46 | −650 | 89 | −54 | −35 |
| Exp. 5 | −640 | 89 | −100 | −41 | −620 | 88 | −57 | −28 |
| Exp. 6 | −660 | 91 | −90 | −50 | −640 | 89 | −46 | −20 |
| Exp. 7 | −650 | 93 | −94 | −48 | −630 | 90 | −49 | −20 |
| Exp. 8 | −640 | 94 | −97 | −46 | −600 | 90 | −24 | −10 |
| Exp. 9 | −620 | 90 | −76 | −39 | −590 | 87 | −37 | −12 |
| Exp. 10 | −630 | 91 | −68 | −40 | −590 | 86 | −30 | −6 |
| Exp. 11 | −620 | 92 | −74 | −44 | −580 | 89 | −32 | −7 |
| Comp. 1 | −690 | 92 | −180 | −160 | −590 | 89 | −80 | −60 |
| Comp. 2 | −700 | 94 | −190 | −140 | −600 | 85 | −100 | −80 |

As shown in Table 4, the values of $V_0$ and $V_i$ vary extensively when the intermediate layer does not comprise the sulfonic acid.

The photoconductor thus obtained was placed in the laser-beam printer "Laser Jet 111" (trademark, manufactured by Hewlett Packerd Co., Ltd.).

Image qualities are measured by counting number of black dots of 0.2 mm or over in diameter produced on the area with four equal sides of 90 mm in a surface of the photoconductor. The measurements were performed at a beginning and at an end of printing 10,000 sheets of paper. The measurements were performed by under the circumstances of: high temperature and humidity (H.H: 35° C., 85% RH); room temperature and humidity (N.N: 25° C., 50% RH); and low temperature and humidity (L.L: 10° C., 50% RH).

The results were listed in Table 5.

In the table, each symbol indicates a number of the black dots (N): "−" means N<5; "+" means 5≦N<20; "++" means 20≦N<50; and "+++" means 50≦N.

TABLE 5

| | Initial | | | After 10,000 repetition | | |
|---|---|---|---|---|---|---|
| No. | L.L | N.N | H.H | L.L | N.N | H.H |
| Exp. 1 | − | − | + | + | − | + |
| Exp. 2 | − | − | + | + | − | + |
| Exp. 3 | − | − | + | + | − | + |
| Exp. 4 | − | − | + | + | − | + |
| Exp. 5 | − | − | + | + | − | + |
| Exp. 6 | − | − | + | + | − | + |
| Exp. 7 | − | − | + | + | − | + |
| Exp. 8 | − | − | + | + | − | + |
| Exp. 9 | − | − | + | + | − | + |
| Exp. 10 | + | − | ++ | + | + | ++ |
| Exp. 11 | + | − | ++ | + | + | ++ |
| Comp. 1 | low conc. | − | fog | +++ fog | ++ fog | +++ fog |
| Comp. 2 | − | − | + | ++ fog | ++ fog | ++ fog |

In spite of repeating cycles of image formation or repeating the printings, as shown in Table 5, each photoconductor of Examples 1–11 is able to provide good image qualities without causing deterioration while each photoconductor of Comparative examples 1 and 2 cannot provide good image qualities.

Therefore, these results lad to the conclusion given below. That is, the photoconductor for electrophotography in accordance with the present invention comprises an intermediate layer made of a harden film prepared by hardening an amino resin by a catalyst including aromatic sulfonic acid and/or alicyclicsulfonic acid, so that it has a sufficiently low electric resistance and a stable structure with capabilities of withstanding against large or small environmental changes. Accordingly, there is no need to provide the intermediate layer as a thin layer as that of the conventional one and thus the intermediate layer of the present invention can be prepared as a layer having a thickness larger than that of the conventional one in one order or over. The thick intermediate layer of the present invention shows excellent electric properties of providing good image qualities without causing troubles by the surroundings during the period of repeating the cycles of image formation. Thus the photoconductor of the present invention has the stable electric properties which are not affected by the environmental condition. Furthermore, various kinds of defects on a surface of the electrically conductive substrate can be covered by forming a thick intermediate layer thereon and thus the photosensitive layer can be also formed as a uniform layer on the intermediate layer with a few membrane defects. Particularly in the photoconductor in the type of having the functionally distinguishable layers (i.e., a charge generation layer and a charge transport layer which are laminated on the electrically conductive substrate in that order), the charge generation layer can be formed easily as a thin layer without causing an uneven surface thereof. Accordingly, it is possible to increase the productivity of the photoconductor for providing the good image qualities without causing image defects.

It is noted that the hardness of the intermediate layer can be increased by incorporating a latent acid of the sulfonic acid, an inorganic acid, a latent acid of the inorganic acid, an organic acid except the sulfonic acid, or a latent acid of the organic acid in the hardening catalyst described above.

Furthermore, the amount of the aromaticsulfonic acid and/or the alicyclicsulfonic acid to be included in the layer can be comparatively decreased by adding the agent for lowering the resistance such as iodine and ferric chloride in the intermediate layer, and thus it is possible to improve the physical properties such as adhesive properties, strength, hardness, and resistance to solvents of the hardened amino resin formed as the intermediate layer.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An electrophotographic photoconductor comprising:

an electrically conductive substrate;

a photosensitive layer formed on said electrically conductive substrate; and an intermediate layer formed between said electrically conductive substrate and said photosensitive layer, wherein said intermediate layer is made of a hardened film formed by hardening an amino resin with a catalyst comprising at least one acid selected from a group of organic acids inorganic acids, and mixtures thereof:

wherein said organic acids includes aromaticsulfonic acid, alicyclicsulfonic acid, and mixtures thereof;

wherein said inorganic acids includes hydrochloric acid, hydroflouric acid, hydrobromic acid, sulfuric acid, phosphoric acid, and boric acid; and wherein said inorganic acid is comprised in said catalyst with or without said organic acid.

2. An electrophotographic photoconductor as claimed in claim 1, wherein said amino resin is a compound selected from a butylated urea resin, a butylated melamine resin, a butylated benzoquanamine resin, and a butylated benzoguanamine resin, and a butylated benzoguanamine co-polymer resin, which is prepared by reacting alcohol with a methylol compound obtained by a reaction between formaldehyde and a compound selected from a group of urea compounds including dicyandiamide, urea, and thiourea and triazine compounds including melamine, isomelamine, benzoguanamine, and acetoguanamine.

3. An electrophotographic photoconductor as claimed in claim 1, wherein said aromaticsulfonic acid and said alicyclicsulfonic acid are compounds in which sulfonic groups are directly bound to aromatic and alicyclic group, respectively, and selected from a group of benzenesulfonic acid, paratoluenesulfonic acid, 2-naphthalenesulfonic acid, dodecylbenzenesulfonic acid, dinonylnaphthalenesulfonic acid, dinonylnaphthalenedisulfonic acid, camphasulfonic acid, anthraquinone-1,5-disulfonic acid, anthraquinone-2,6-disulfonic acid, anthraquinone-2-sulfonic acid, and derivatives thereof in which aromatic and alicyclic groups are bound to one of aryl, alkyl, and aralkyl groups.

4. An electrophotographic photoconductor as claimed in claim 1, wherein said intermediate layer comprises:

5–100 parts by weight of said organic acid selected from a group of aromaticsulfonic acid, alicyclicsulfonic acid, and a mixture thereof with respect to 100 parts by weight of said amino resin.

5. An electrophotographic photoconductor as claimed in claim 1, wherein said organic acid is comprised in said catalyst with a second organic acid selected from a group of acetic acid, oxalic acid, succinic acid, adipic acid, benzoic acid, 2-naphthalincarbocylic acid, orthofutalic acid, isofutalic acid, trimellitic acid, pyromellitic acid, maleic acid, fumaric acid, itaconic acid, linolic acid, endomethylene tetrahydrophtalic acid, and latent acids thereof, with or without said inorganic acid.

6. An electrophotographic photoconductor as claimed in claim 5, wherein said catalyst comprises:

0.1–10 mol of an acid selected from said second organic acid, said inorganic acid, and a mixture thereof with respect to 1 mol of said organic acid selected from a group of aromatic sulfonic acid, alicyclic sulfonic acid, and mixtures thereof.

7. An electrophotographic photoconductor as claimed in claim 1, wherein said intermediate layer further includes a compound selected from a group of iodine, ferric chrolide, and a mixture thereof.

8. An electrophotographic photoconductor as claimed in claim 1, wherein said intermediate layer further includes a compound selected from a group of alkyd resin and phenol resin.

9. An electrophotographic photoconductor as claimed in claim 1, wherein said intermediate layer further includes a filler selected from a group of titanium oxide, aluminum oxide, kaolin, talc, and silicon oxide.

10. An electrophotographic photoconductor as claimed in claim 1, wherein said photosensitive layer is in the type of having functionally distinguishable layers and is composed of a charge generation layer and a charge transport layer.

11. An electrophotographic photoconductor as claimed in claim 10, wherein said charge generation layer includes at least one charge-generating material selected from a group of: inorganic charge-generating materials including selenium-tellurium and selenium-arsenic; organic charge-generating materials including azo pigment, disazo pigment, perynon pigment, perylene pigment, anthanthrone pigment, phtalocyanine pigment, pyrylium pigment, and squaraines pigment.

12. An electrophotographic photoconductor as claimed in claim 10, wherein said charge transport layer is composed of:

a compound selected from a group of indole derivatives, enamine compounds, amine compounds, hydrazone compounds, styryl compounds, butadiene compounds, triphenylmethane compounds, and pirazoline compounds; and a binder resin which is mutually soluble to said compound, preferably selected from a group of polycarbonate resin, polystyrene resin, styrene resin, and acrylate resin.

13. An electrophotographic photoconductor as claimed in claim 1, wherein said electrically conductive substrate is made of a material selected from: non-conductive materials having a surface treated to be electrically conductive by a treatment selected from a metal deposition, a metal plating, and an application of an electrically conductive paint, including plastic, paper, carbon powder dispersed plastics and glass; and conductive materials including iron, nickel, and aluminum.

* * * * *